US009593920B2

(12) United States Patent
Song

(10) Patent No.: US 9,593,920 B2
(45) Date of Patent: Mar. 14, 2017

(54) ARROW SHAFT WITH STRAIGHTNESS MARKING THEREON

(71) Applicant: Jin Hee Song, Busan (KR)

(72) Inventor: Jin Hee Song, Busan (KR)

(73) Assignee: Jin Hee Song, Busan (KR)

( * ) Notice: Subject to any disclaimer, the term of this patent is extended or adjusted under 35 U.S.C. 154(b) by 0 days.

(21) Appl. No.: 14/327,889

(22) Filed: Jul. 10, 2014

(65) Prior Publication Data

US 2015/0051029 A1 Feb. 19, 2015

(30) Foreign Application Priority Data

Jul. 11, 2013 (KR) ..... 10-2013-0081663

(51) Int. Cl.
*F42B 6/04* (2006.01)

(52) U.S. Cl.
CPC ..... *F42B 6/04* (2013.01)

(58) Field of Classification Search
CPC ..... F42B 6/04; F42B 6/06
See application file for complete search history.

(56) References Cited

U.S. PATENT DOCUMENTS

| | | | | | |
|---|---|---|---|---|---|
| 613,386 | A * | 11/1898 | McKenney | 473/586 | |
| 2,277,743 | A * | 3/1942 | Crossman | 473/586 | |
| 4,155,172 | A | 5/1979 | Bartol | | |
| 5,273,293 | A * | 12/1993 | Lekavich | 473/578 | |
| 5,533,272 | A | 7/1996 | Bagwell | | |
| 6,129,642 | A * | 10/2000 | DonTigny | 473/578 | |
| 6,595,880 | B2 * | 7/2003 | Becker | 473/578 | |
| 7,758,457 | B2 * | 7/2010 | Marshall | 473/586 | |
| 2012/0165141 | A1 | 6/2012 | Connolly | | |
| 2014/0116152 | A1 * | 5/2014 | Johnston | F41B 5/148 73/849 | |
| 2014/0256481 | A1 * | 9/2014 | Flint | F42B 6/04 473/578 | |

FOREIGN PATENT DOCUMENTS

| | | | |
|---|---|---|---|
| KR | 20-0232099 | Y1 | 7/2001 |
| KR | 10-2008-0082878 | A | 9/2008 |
| KR | 10-2011-0042436 | A | 4/2011 |

* cited by examiner

*Primary Examiner* — John Ricci
(74) *Attorney, Agent, or Firm* — The PL Law Group, PLLC

(57) ABSTRACT

An arrow shaft includes a straightness marking that indicates a position of straightness of an arrow shaft. Accordingly, a user can shoot in consideration of the error in the straightness, thereby facilitating the adjustment of a zero point and formation of a shot group, and also improving the flight stability of the arrow.

7 Claims, 4 Drawing Sheets

ARROW SHAFT WITH STRAIGHTNESS MARKING THEREON

CROSS-REFERENCE TO RELATED APPLICATION AND CLAIM OF PRIORITY

This application claims the benefit of Korean Patent Application No. 10-2013-0081663, filed on Jul. 11, 2013, in the Korean Intellectual Property Office, the disclosures of which are incorporated herein in their entirety by reference.

BACKGROUND

1. Field of the Invention

The present invention relates to an arrow shaft, and in particular, to an arrow shaft including a straightness marking.

2. Description of the Related Art

An arrow shaft is classified with a variety of materials and types, but recently, arrow shafts using carbon fibers have become more mainstream.

In general, such an arrow shaft is manufactured via cutting of a carbon prepreg treated sheet, laminating and winding, taping, heat treatment and cooling, core removing, and grinding.

Ideally, the arrow shaft manufactured as above should have a true straightness. However, some arrow shafts actually do not retain a true straightness, and therefore, at least a portion of the arrow shaft has a curved shape.

Korean Patent Laid-Open Publication No. 10-2011-0042436, Korean Utility Model Registration No. 20-0232099, U.S. Pat. No. 4,155,172, and U.S. Pat. No. 5,533,272 disclose methods for measuring a straightness of a manufactured arrow shaft, and U.S. Patent Laid-Open Publication No. US2012/0165141 A1 proposes a method for improving a straightness of a manufactured arrow shaft.

As shown in FIG. 2, the straightness of such an arrow shaft is defined by a numerical value converted from the distance between a virtual axial center line (BL) of an arrow shaft having ideally a straight shape, and an actual axial center line (CL) of an arrow shaft to be measured.

For example, the numerical value for the straightness of an arrow shaft 101 may be indicated by ±0.0025 inch, and such a numerical value may be printed on the package of a six-pack or a twelve-pack of arrow shafts for sale. A numerical value for the straightness to be printed on the package of arrow shafts is generally the maximum value. The lower (absolute) value of straightness means an ideal straight line. An arrow shaft having lower values of straightness becomes more expensive.

In the case of users using various arrows for hunting and game, users may mount two to five sheets of fletching on the outer circumferential surface of the arrow shaft. Korean Patent Laid-Open Publication No. 10-2008-0082878, entitled "SHAFT OF AN ARROW," discloses a technique wherein fletching indication patterns are previously provided on the arrow shaft to allow for more accurate mounting of the fletching. However, in case of above Korean Patent Laid-Open Publication No. 10-2008-0082878, fletching patterns are simply marked as radially spaced apart from each other similar angles along the circumferential surface, and thus it is not possible to compensate for errors in the straightness of the arrow shaft at all.

That is, as described above with reference to FIG. 2, an arrow shaft inevitably has a value of straightness corresponding to the value of an error being deviated from an ideal value of straightness. The higher value of straightness (i.e., the "value of an error" or "error of straightness") gives adverse effects on the flight performance and accuracy of the arrow.

SUMMARY

In view of the above, one or more embodiments of the present invention provides an arrow shaft with a straightness marking that is capable of compensating for an error in the straightness of an arrow shaft inevitably caused by a manufacturing process, and to provide for manufacturers or users of arrows to shoot in consideration of such errors in the straightness, thereby facilitating the formation of a shot group or an adjustment of a zero point, and also improving the flight performance of the arrow during shooting.

In accordance with an embodiment of the present invention, provided is a cylindrical arrow shaft, which includes a straightness marking formed on the outer circumferential surface of the arrow shaft, wherein when an actual center line (CL) of the arrow shaft is rotated about an ideal reference center line (BL) as a rotating axis, and while viewing from one direction perpendicular to the reference center line in the longitudinal direction of the arrow shaft, the straightness marking may be formed in a direction perpendicular to both the one direction and the reference center line, at a rotating position where a deviation between the actual center line and the reference center line of the arrow shaft becomes a maximum.

In one embodiment, the reference center line is a center line in a longitudinal direction, and the center line in a longitudinal direction is a line when the arrow shaft has an ideal straight shape.

Further, the actual center line is extended through centers of each cross sectional position of the longitudinal direction of the arrow shaft.

Further, the deviation corresponds to an area of a closed curve that is formed by interconnecting the reference center line and the actual center line at both ends.

Further, the deviation corresponds to the distance between the reference center line and the actual center line in a direction perpendicular to the reference center line.

Further, the straightness marking is formed on a rear portion of the arrow shaft, a reference fletching is mounted on a position having the straightness marking, and wherein one or more non-reference fletchings are mounted with spacing apart from each other in a circumferential direction from the reference fletching.

Further, the color of the reference fletching is different from the colors of the non-reference fletchings.

Further, the straightness marking has a predetermined length extending in a longitudinal direction of the arrow shaft, and the predetermined length may be changed depending on the maximum deviation.

According to embodiments of the present invention, a straightness marking is previously formed on the rear portion of a circumferential surface of a portion where a maximum error of straightness of the arrow shaft exists. Accordingly, a user can shoot in consideration of such an error in the straightness, thereby facilitating the adjustment of a zero point and formation of a shot group, and also improving the flight stability of the arrow(s). Further, a manufacturer, a user, or the like, of an arrow may be able to mount a reference fletching on a portion where a straightness marking is formed, and may be able to shoot in consideration of such an error in straightness, using the reference fletchings.

BRIEF DESCRIPTION OF THE DRAWINGS

The features and advantages of the present invention will be more apparent from the following detailed description in conjunction with the accompanying drawings, in which.

DETAILED DESCRIPTION

Hereinafter, exemplary embodiments of the present invention will be described in detail with reference to the accompanying drawings. However, the embodiments described herein are exemplary only and are not intended to limit the scope of the invention.

In the following description, well-known functions or constitutions will not be described in detail because they may obscure the gist of the present invention. Further, the terminologies to be described below are defined in consideration of the functions within the scope of the present invention and may vary depending on a user's or operator's intention or practice. Accordingly, some definitions are implied based on the content throughout the specification.

Figure 1:
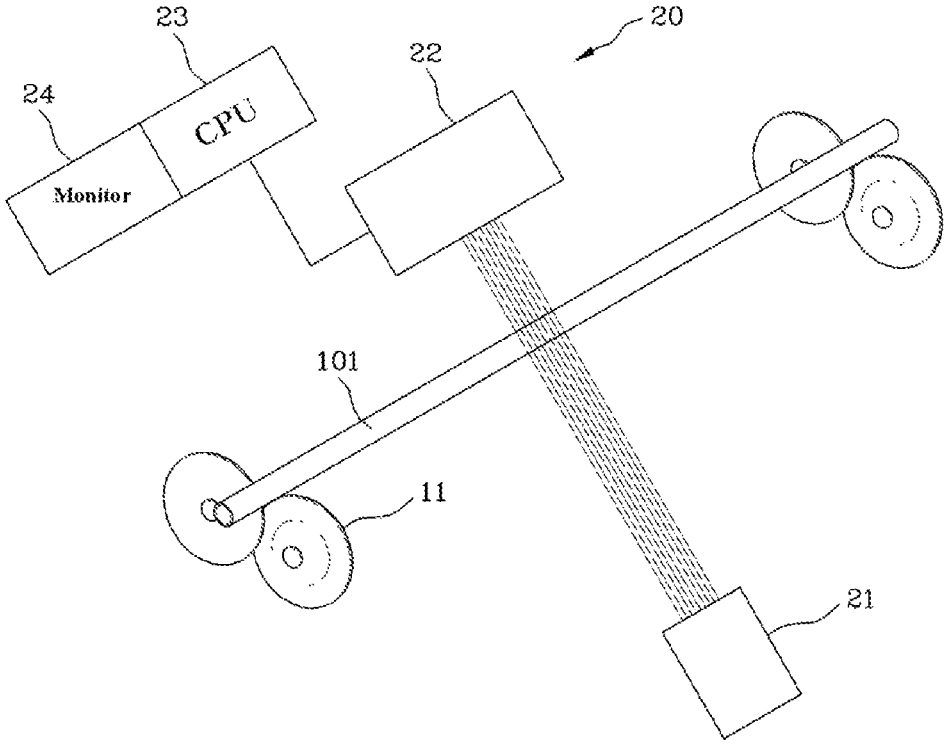
FIG. 1 is a schematic view illustrating an instrument system for measuring straightness in the manufacturing of an arrow shaft according to an embodiment of the present invention.

FIG. 1 is a schematic view illustrating an instrument system for measuring the straightness during the manufacturing of arrow shafts according to the present invention.

The straightness of the manufactured arrow shaft 101 may be measured in a number of ways. For example, straightness may be measured visually as Korean Patent Laid-Open Publication No. 10-2011-0042436 or measured using a dial gauge as described in Korean Utility Model Registration No. 20-0232099.

Further, as shown in FIG. 1, a numerical value of the straightness of the arrow shaft 101 may be measured using a laser scan micrometer 20. As shown in FIG. 1, the manufactured arrow shaft 101 is placed on a roller 11 that includes a mode of rotating 101 manually or automatically. When 101 is rotated by the rotating roller 11, the degree of curvature in 101 (i.e., an error in straightness) may be measured by a laser transmitter 21 and a laser receiver 22.

Here, the laser transmitter 21 may be an oscillator that is equipped with an amplifier, a photoelectric device, and a condenser lens. The laser receiver 22 is equipped with a polygon mirror, a motor, and a collimator lens inside thereof. With this configuration, a portion of a laser beam transmitted from the laser transmitter 21 may be sent back to the laser transmitter 21 by the polygon mirror. The laser scan micrometer 20 is a non-contact measuring device, which measures automatically an outer diameter, length, shape, and thickness, etc. of the object to be measured.

The laser scan micrometer 20 may be coupled to a central processing unit (CPU) 23 and a monitor 24. With the utilization of the CPU and the monitor, the laser scanning micrometers 20, the numerical value of the straightness of the initial state of the manufactured arrow shaft 101, and a portion having a maximum numerical value of straightness for the arrow shaft 101 (i.e., a position of the maximal curvature of the arrow shaft 101) can be obtained.

Figure 2:
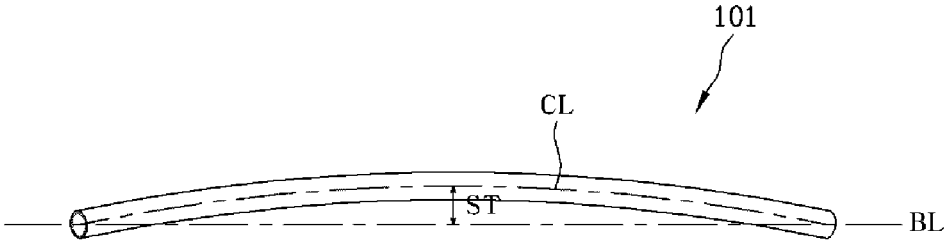
FIG. 2 is a side view of an arrow shaft illustrating a reference line to measure the straightness with a numerical value.

As shown in FIG. 2, the manufactured arrow shaft 101 may not be an ideal linear shape (i.e., an ideal straight shape) and may have a slight curvature.

When a deviation in the straightness between the reference center line (BL) in the longitudinal direction of the arrow shaft 101 (i.e., the center line under the assumption that the arrow shaft 101 is of an ideal straight shape; or when the numerical value of straightness is zero) and the actual center line (CL) (i.e., the center line being extended through centers of each cross sectional position (e.g., the circular cross sectional position) of the actually curved arrow shaft 101)) becomes a maximum (i.e., this maximum deviation (ST) is defined as a value of straightness). Here, the term "deviation" may be the distance between the reference center line (BL) and the actual center line (CL) while viewing in the direction perpendicular to the reference center line (BL), and the maximum deviation (ST) may mean a maximum distance. For example, as shown in FIG. 2, in the case where the arrow shaft 101 is manufactured with a convex arc shape in an upper direction, the distance at the position where a perpendicular distance from the reference center line (BL) becomes a maximum may be regarded as the maximum deviation (ST), which may be defined as a value of straightness.

However, the term "deviation", which is the basis of the maximum deviation (ST) for indicating a value of straightness for the arrow shaft 101, is without limitation and may be defined in a variety of ways. For example, in both the reference center line (BL) and the actual center line (CL), an area of a closed curve that is formed by interconnecting the reference center line (BL) and the actual center line (CL) at both ends may be defined as "deviation".

According to an embodiment of the invention, as shown in FIG. 2, when the actual center line (CL) of the arrow shaft 101 is rotated about the reference center line (BL) in a rotating axis while viewing from one direction (e.g., the direction into the drawing paper in FIG. 3A) perpendicular to the ideal reference center line (BL) in the longitudinal axis direction of the arrow shaft 101, a rotating position where the deviation between the actual center line (CL) and the reference center line (BL) may be identified as a maximum. Identifying the rotating position having a maximum deviation may be realized via the laser scanning micrometer 20, as shown in FIG. 1. FIG. 2 and FIGS. 3A and 3B depict the arrow shaft 101 when the deviation between the actual center line (CL) and the reference center line (BL) becomes a maximum (i.e., when the arrow shaft 101 is at the rotating position where the deviation becomes a maximum). Furthermore, FIGS. 3A and 3B depict a side view and a plan view respectively of the arrow shaft 101, with respect to the rotating position of the arrow shaft 101 having a maximum deviation (ST), in accordance with an embodiment of the present invention.

Figure 3:
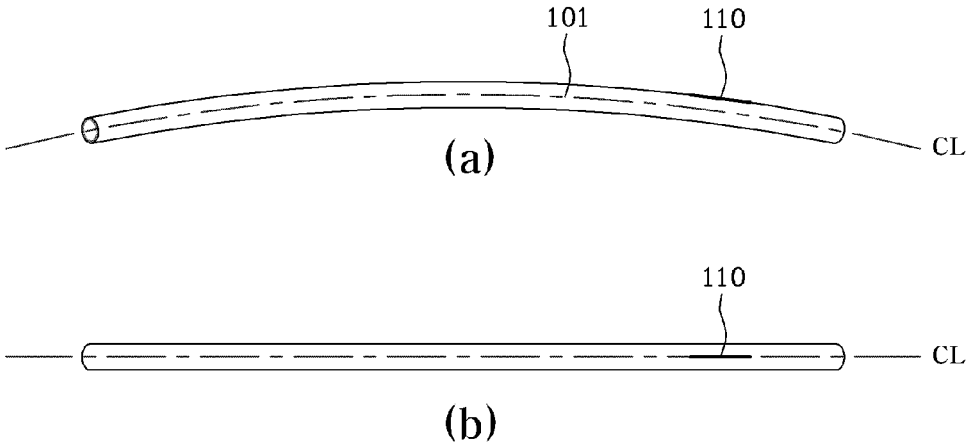
FIG. 3A is a side view of an arrow shaft according to an embodiment of the present invention.
FIG. 3B is a plan view of an arrow shaft according to an embodiment of the present invention.

As shown in FIGS. 3A and 3B, at a rotating position having a maximum deviation between the actual center line (CL) and a reference center line (BL), a straightness marking 110 is formed in the direction perpendicular to both the one direction (e.g., the direction into the drawing paper in FIG. 3A) and the reference center line (BL). As the straightness marking 110 is formed in the direction perpendicular to the reference center line (BL) at a rotating position having a maximum deviation, it is possible to indicate the direction where the arrow shaft 101 has a value of straightness. The straightness marking 110 is formed on the outer circumferential surface of the arrow shaft 101. The straightness marking 110 may have shapes corresponding to a straight line, a segment, an arrow, or the like. Hereinafter, for example, the straightness marking 110 having the shape of a segment with a predetermined length extending to the actual center line (CL) is described. Here, the shape of a segment may include the shapes of a continuous line, a dotted line, or a broken line. The straightness marking 110 may be formed on the rear portion of the outer circumferential surface of the arrow shaft 101. Further, the straightness marking 110 may be formed on an upper portion or on a lower portion of the rear portion of an outer circumferential surface of the arrow shaft 101. Hereinafter, as shown in FIG. 3, the straightness marking 110 is formed on the upper portion of the rear portion of the outer circumferential surface as described.

Specifically, at a rotating position having a maximum deviation (ST) as shown in FIGS. 3A and 3B, the straightness marking 110 may be formed on the rear portion of the circumferential surface of the right upper portion in the center line (CL) of the arrow shaft 101. The straightness marking 110 may be formed on the rear portion of the circumferential surface of the arrow shaft 101 with a hollow tubular shape so as to have a predetermined length in the direction of the actual center line (CL).

The straightness marking 110 may indicate the direction where the arrow shaft 101 has a maximum deviation. In other words, when a user shoots an arrow, the user is able to identify in advance the direction where the arrow shaft 101 has a maximum deviation. Therefore, the user is able to shoot in consideration of the potential error caused by the deviation, thereby facilitating the adjustment of a zero point and formation of shot group for an arrow(s), and also improving the flight stability of the arrow.

When the straightness marking 110 is formed in the shape of a segment having a predetermined length, the length of the segment may be changed depending on the numerical value of straightness (i.e., depending on the scale of a maximum deviation). Therefore, the value for the straightness of the arrow shaft 101 may be estimated with the length of the segment. Also, the straightness marking 110 and the numerical value of straightness may be marked together.

Figure 4:
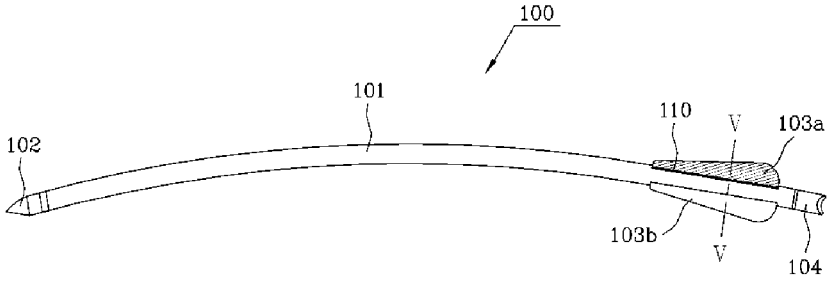
FIG. 4 is a side view of an arrow in accordance with an embodiment of the present invention.
Figure 5:
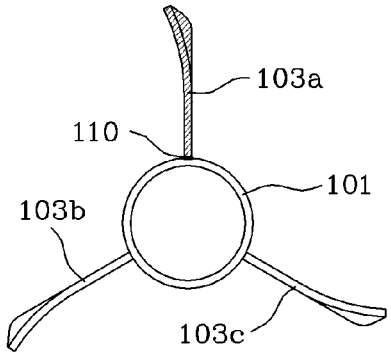
FIG. 5 is a perspective view taken along the cutting line V-V of FIG. 4.

FIG. 4 is a side view of an arrow as an embodiment of the present invention, and FIG. 5 is a cross sectional view taken along the line V-V of FIG. 4.

As shown in FIG. 4, a general arrow 100 is configured in a way that the arrow head 102 is coupled to the front end of the arrow shaft 101, and a notch 104 is coupled to the rear end of the arrow shaft 101. In addition, two to five sheets of fletching 103 are adhered or combined on the rear portion of the outer circumferential surface of the arrow shaft 101 in order to improve the flight performance of the arrow. In this embodiment, three sheets of fletchings 103*a*, 103*b*, and 103*c* are adhered on the arrow shaft 101, however, the number of fletchings is without limitation. Further, the fletchings 103 may be adhered or combined to the arrow shaft 101 during the manufacturing process of the arrow. Otherwise, a user or an end-consumer may choose the fletchings 103 suitable for the user's own benefit and may adhere or combine them directly in their desired positions.

Here, one of the fletchings 103*a*, 103*b*, and 103*c* may have a different color. The different colored fletching may be defined as the reference fletching 103*a*. The other fletchings may be defined as the non-reference fletchings 103*b* and 103*c*. The reference fletching 103*a* may be the fletching that the user takes as a reference when shooting the arrow 101. Based on the reference fletching 103*a*, the user may adjust the zero point and make a formation of a shot group, and may also sight an aiming point according to user's shooting habit(s).

As described above, there exists an error in the straightness of the arrow shaft 101. Here, the reference fletching 103*a* is adhered or combined to the arrow shaft 101 in accordance with the straightness marking 110, indicating a direction that a maximum value of error in the straightness exists, thereby allowing the user to easily compensate for errors in the arrow shaft 101 that may be deviated from an ideal straight line. In other words, while shooting arrows in consideration of the error in the straightness with the reference fletching 103*a*, a user may form a more exact shot group, and adjust a zero point according to the user's preferable aiming and shooting habits. For example, while shooting the arrow 101 several times based on the reference fletching 103*a* mounted on the straightness marking 110, a user may find the shooting and aiming points with improved accuracy, thereby adequately adjusting the zero point of the bow and the arrow.

Figure 6:
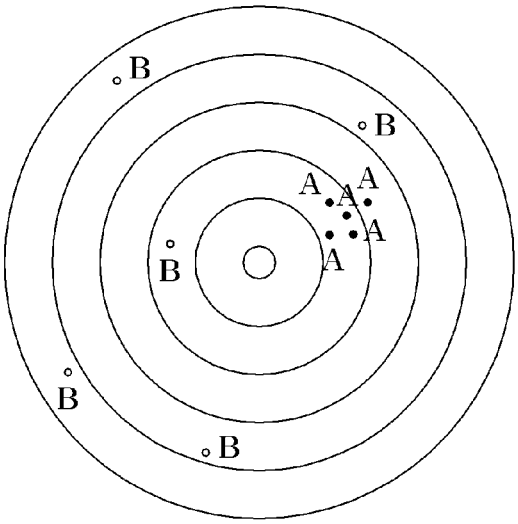
FIG. 6 is a front view of a target for an arrow illustrating results garnered by using an embodiment of the present invention.

When shooting arrows several times under the state wherein the reference fletching 103*a* and non-reference fletchings 103*b* and 103*c* are mounted on any position of the arrow shaft 101, having no straightness marking 110 (e.g., as indicated by "B" in FIG. 6), the direction of the maximum deviation of the arrow shaft 101 is not able to be adjusted. Accordingly, it would be difficult to adjust the zero point and form an accurate grouping of arrows. On the other hand, in cases where shooting arrows several times under the state that the reference fletching 103*a* is mounted on the position where the straightness marking 110 is formed, according to an embodiment of the present invention (e.g., as indicated by "A" in FIG. 6), the arrows are formed a group within a certain range, thereby improving shooting accuracy. It should be understood that under the state that the reference fletching 103*a* is mounted on the position having a maximum straightness, shooting the arrow 101 is compensated for with respect to the error in the straightness of the arrow shaft 101.

As set forth above, while the present invention has been described in detail through exemplary embodiments, it is to be understood by those skilled in the art that the exemplary embodiments may be modified without departing from the scope of the present invention. Therefore, the scope of the present invention is not limited to the described embodiments and is defined by the appended claims and their equivalents.

What is claimed is:

1. A cylindrical arrow shaft, comprising:

a straightness marking formed on the outer circumferential surface of the arrow shaft, wherein when the arrow shaft is placed at a position where a deviation between the actual center line and the ideal reference center line of the arrow shaft becomes a maximum, a closed curve is formed by interconnecting an ideal reference center line (BL) and an outer circumferential line of the arrow shaft at the position, and the straightness marking is placed on the outer circumferential line of the arrow shaft;

wherein the straightness marking is formed on a rear portion of the arrow shaft;

wherein a reference fletching is mounted on a position having the straightness marking; and wherein one or more non-reference fletchings are mounted with spacing apart from the reference fletching in a circumferential direction.

2. The arrow shaft of claim 1, wherein the reference center line is a center line in the longitudinal direction when the arrow shaft has an ideal straight shape.

3. The arrow shaft of claim 1, wherein the actual center line is extended through a center of each cross sectional position in the longitudinal direction of the arrow shaft.

4. The arrow shaft of claim 1, wherein the deviation corresponds to an area of a closed curve that is formed by interconnecting the reference center line and the actual center line at both ends.

5. The arrow shaft of claim 1, wherein the deviation corresponds to a maximum distance between the reference center line and the actual center line in a direction perpendicular to the reference center line.

6. The arrow shaft of claim 1, wherein a color of the reference fletching is different from a color of the non-reference fletchings.

7. The arrow shaft of claim 1, wherein the straightness marking has a predetermined length extending in a longitudinal direction of the arrow shaft; and wherein the predetermined length is determined depending on the maximum deviation.

* * * * *